United States Patent [19]

Bly

[11] 4,209,094

[45] Jun. 24, 1980

[54] BOTTLE TRAY

[75] Inventor: Ray E. Bly, Spokane, Wash.

[73] Assignee: R. A. Pearson Company, Spokane, Wash.

[21] Appl. No.: 4,899

[22] Filed: Jan. 19, 1979

[51] Int. Cl.[2] ..... B65D 75/00; B65D 61/00

[52] U.S. Cl. ..... 206/427; 220/21; 206/563; 206/589

[58] Field of Search ..... 206/45.14, 45.19, 427, 206/433, 485–486, 490, 521, 526, 562–564, 588–589, 156, 158, 434, 435; 229/29 F, 32; 220/21, 22; 312/138 R, 138 A

[56] References Cited

U.S. PATENT DOCUMENTS

| | | | |
|---|---|---|---|
| 734,856 | 7/1903 | Hahn | 206/490 X |
| 1,002,633 | 9/1911 | Boos | 206/44 R |
| 2,459,921 | 1/1949 | Corner | 220/21 |
| 2,955,707 | 10/1960 | Foote | 206/427 |
| 3,669,251 | 6/1972 | Phillips, Jr. | 206/45.14 X |
| 3,841,476 | 10/1974 | Elford | 206/427 |

FOREIGN PATENT DOCUMENTS

| | | | |
|---|---|---|---|
| 890299 | 2/1962 | United Kingdom | 206/433 |

*Primary Examiner*—Herbert F. Ross
*Attorney, Agent, or Firm*—Wells, St. John & Roberts

[57] ABSTRACT

A tray for receiving and supporting a group of bottles, particularly plastic bottles of a lightweight nature. The tray, made from precut paperboard or corrugated paperboard or other relatively stiff sheet material, has parallel top and bottom surfaces spaced vertically. The top surface has an opening complementary to the border configuration about the cylindrical sides of bottles within a rectangular group. This is presented in the form of scallops, each scallop being semi-circular to frictionally engage the barrel of a bottle about the border of the group. The heels of the bottles rest upon the bottom surface of the tray for vertical support. The bottles are frictionally engaged about their barrels to maintain the group of bottles within the tray by slight compressive tangential engagement of the bottles with one another.

4 Claims, 7 Drawing Figures

BOTTLE TRAY

BACKGROUND OF THE INVENTION

This invention relates to a lightweight tray for receiving, supporting and storage of lightweight plastic bottles. While it is not to be limited in its application, the tray is specifically adapted for plastic bottles such as are used in the carbonated beverage industry. These plastic bottles are supplanting heavier glass bottles, which are typically shipped in cartons or in heavy crates made from wood or rigid plastic. In the case of larger bottles ranging from one quart (or one liter) to two quarts (or two liters), it is not practical to store more than twelve bottles in an individual crate. Glass bottles are also shipped in bulk packages, using flat support sheets between layers or rectangular trays having vertical side walls. The light weight of plastic bottles makes it possible to store substantial numbers of empty bottles in a large area tray, and such trays can be stacked vertically for bulk storage purposes. The vertically stacked trays can be handled on pallets by mechanized warehousing equipment. As an example, a practical tray according to the present disclosure has been made from normal corrugated cardboard to handle one hundred-twenty two liter empty plastic beverage bottles as an effective storage unit.

One difficulty encountered in handling lightweight plastic bottles is their tendency to be relatively top heavy and to fall over easily if not within a full height box or container. However, it is often advisable to handle and store bottles in a tray, which supports only the heels and lower barrel surfaces of the bottles. Such a tray leaves the labels on the bottles exposed for display purposes, and the majority of the bottle surfaces are accessible for external inspection and engagement by other equipment. The present tray was designed to effectively support lightweight bottles within a relatively low tray capable of storing large numbers of empty bottles. It is further applicable to smaller numbers of filled bottles for storage, display and sales purposes.

DETAILED DESCRIPTION OF A PREFERRED EMBODIMENT

Figure 1:
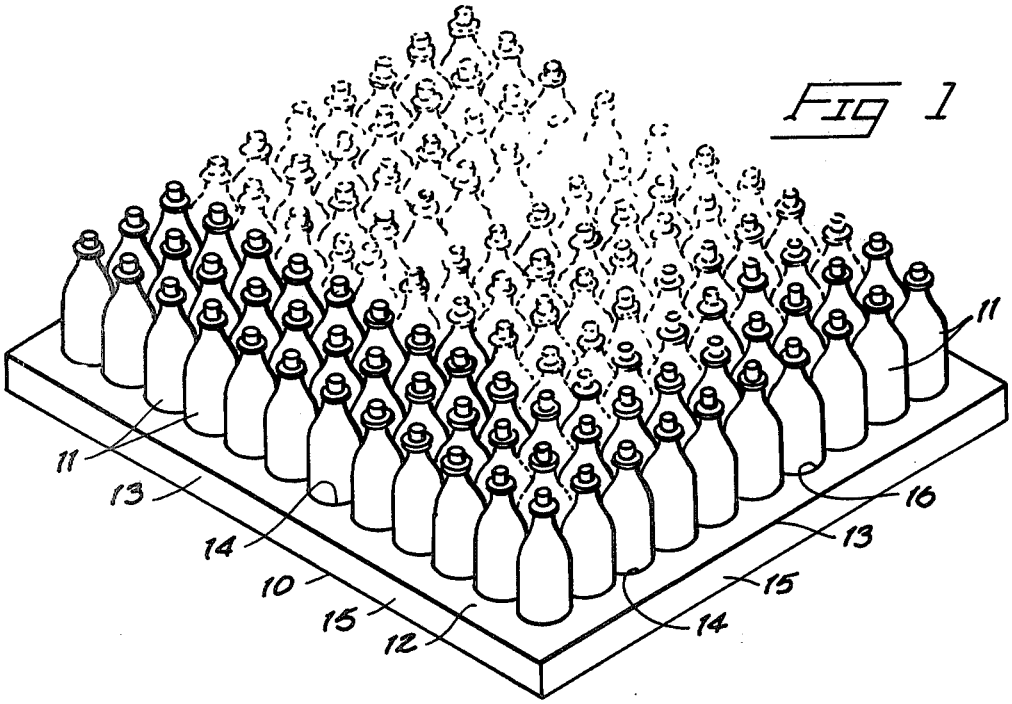
FIG. 1 is a perspective view of the present tray filled with bottles.

The present disclosure relates to a tray for receiving and storing a group of bottles having a substantially cylindrical shape, and preferably made from lightweight plastic materials. However, the tray can be used for storing bottles made from glass or other materials. The exact bottle configuration is not of basic importance to the disclosure, but is primarily cylindrical. Within this general definition of a cylindrical bottle is included bottles that might have annular flanges, upright ribs, spiral flutes and other decorative or functional modifications of the generally cylindrical side walls. The tray is particularly adaptable to lightweight plastic bottles having tapered heels which assist in properly seating the bottles within the described tray structure. The structure of the bottle neck and finish is of no direct consequence to the application and use of the tray. The tray engages only the heels and lower barrel surfaces of bottles.

The tray essentially comprises a lower wall 10 having outer dimensions adequate to support the heels of a group of bottles 11 arranged with all adjacent bottles 11 in tangential direct abutment with one another. The lower wall is relatively stiff so as to be capable of supporting the weight of the group of bottles 11 without external support or reinforcement. The illustrated tray might be made from corrugated paperboard, or from paperboard or plastic materials, either in solid form or molded in a foamed condition.

An upper wall 12 is spaced vertically above the lower wall 10. The upper wall 12 has an outer circumferential edge 13 that corresponds to the shape and dimensions of the lower wall 10. It also includes an inner circumferential edge 14 that overlies the bottom wall 10. The inner edge 14 forms an opening in the upper wall 12 for reception of a group of bottles 11.

The lower wall 10 and upper wall 12 are joined and rigidly supported with respect to one another by means of upright side and end walls 15. The side and end walls 15 space the walls 10, 12 apart in positions parallel to one another and separated by a distance less than the height of the cylindrical sides of an individual bottle 11. Therefore, the upper wall 12 will intersect the barrels of bottles 11 when the heels of the bottles 11 are resting on the lower wall 10. The side and end walls 15 are spaced outwardly from the circumferential edge 14 to define rectangular recesses adapted to receive elongated stiffener members 17. Members 17 may be used to reinforce the trays so they may be re-used several times.

The inner edge 14 of the upper wall 12 is formed in a scalloped pattern having an arcuate edge configuration complementary in both size and shape to the size and shape across the barrels of the individual bottles 11. This pattern, indicated at 16, is repeated about the periphery of the inner edge 14 in a spatial arrangement complementary to the location of the individual bottles 11 bordering a group of bottles on the lower wall 10. In this manner the bottles are frictionally engaged by the inner edge 14 of upper wall 12 and subjected to slight inward compression to maintain the group of bottles 11 within the tray by assuring tangential engagement of the bottles with one another. The result is a well defined group of bottles maintained in direct tangential abutment with one another. The bottles are also held in frictional engagement by the upper wall 12, which prevents the individual bottles 11 from tipping or accidentally becoming dislodged from the remainder of the group.

The essential characteristics of the tray relate to the form of the top surface 17 on the upper wall 12, which defines the bottle receiving opening by means of the semicircular scalloped edges 16. Each semicircular scalloped edge 16 is adapted to partially circumscribe and frictionally engage the barrel of a single bottle 11 along the border of the geometrical array of bottles. The bottles can be arranged in side by side rows of any desired length and width, as illustrated, or the adjacent rows might be nested or staggered. The scalloped edges frictionally engage the bordering bottles 11 to keep the entire group of bottles in tangential direct abutment with one another. The weight of the bottles is supported by the upwardly facing bottom surface 18 on the lower wall 10. The two walls 10, 12 cooperate to support and locate the group of bottles for storage, shipment and handling purposes.

Figure 6:
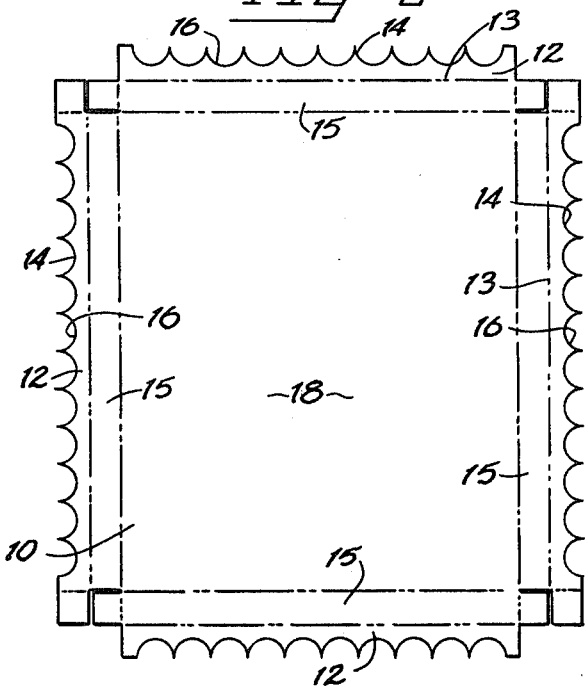
FIG. 6 is a plan view of the blank used to form the tray of FIG. 5.

The tray is illustrated as it would be formed from corrugated paperboard in a single blank (FIG. 6). This blank is preferably precut and scored in the manner common to paper carton processes. It includes complementary tabs and flaps at the ends of the respective portions of the upper wall 12 and the side and end walls 15 which are glued or stapled or otherwise connected to one another to complete a unitary rigid tray structure. The details by which trays are fabricated from such materials are well known in the folding carton industry and need not be further discussed herein. It is to be understood that the tray might alternatively be constructed from two or more elements which might be molded or otherwise fabricated from various materials suitable for the purposes discussed above.

Figure 2:
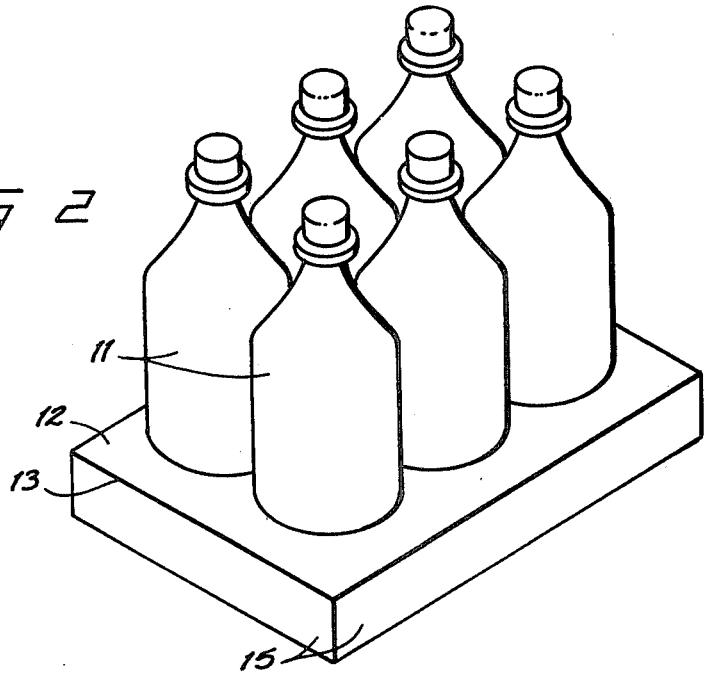
FIG. 2 is a perspective view of a smaller version of the tray in use.
Figure 3:
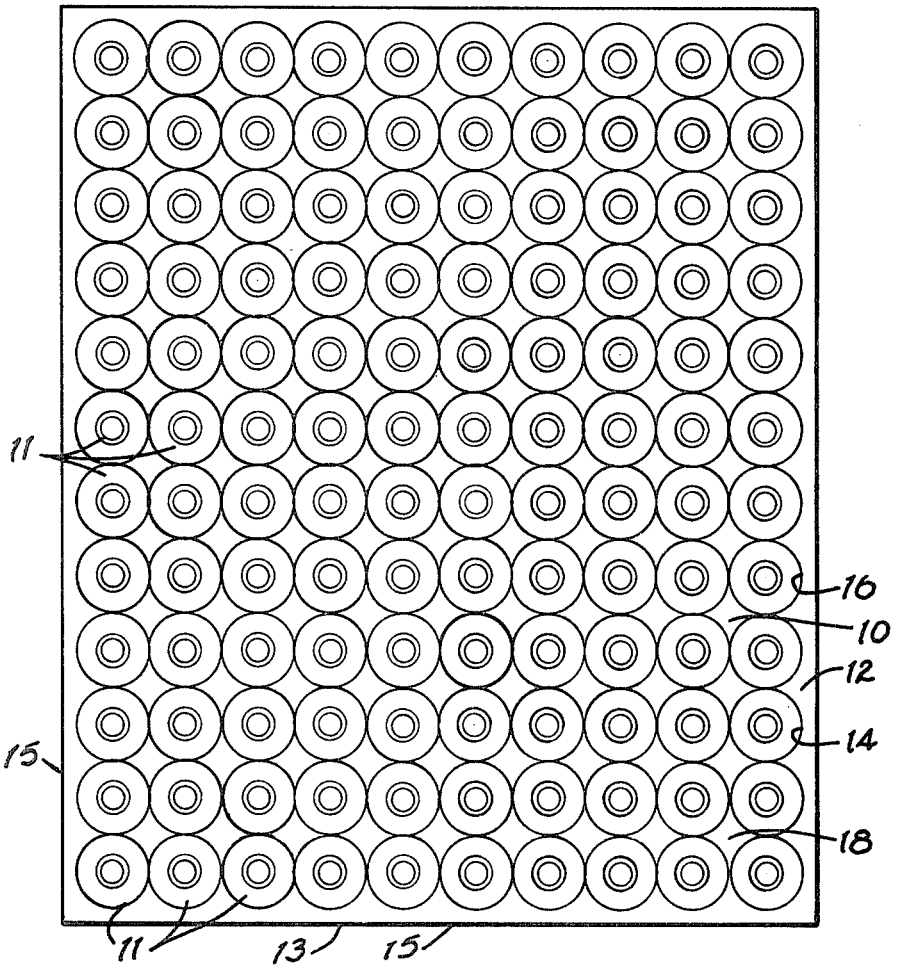
FIG. 3 is a plan view of the tray and bottles.
Figure 4:
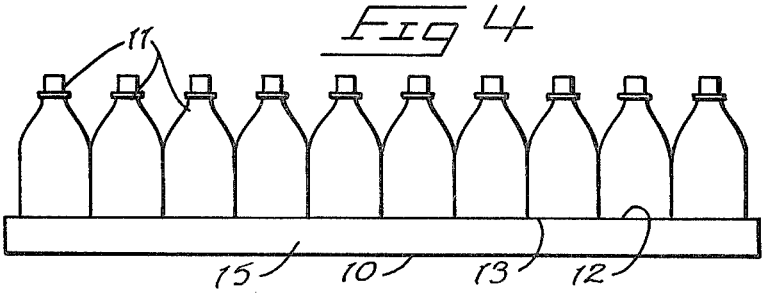
FIG. 4 is a side elevation view of the tray and bottles.
Figure 5:
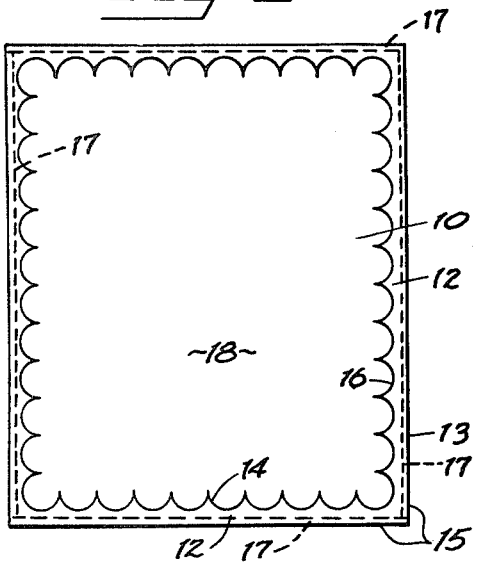
FIG. 5 is a reduced plan view of the empty tray.
Figure 7:
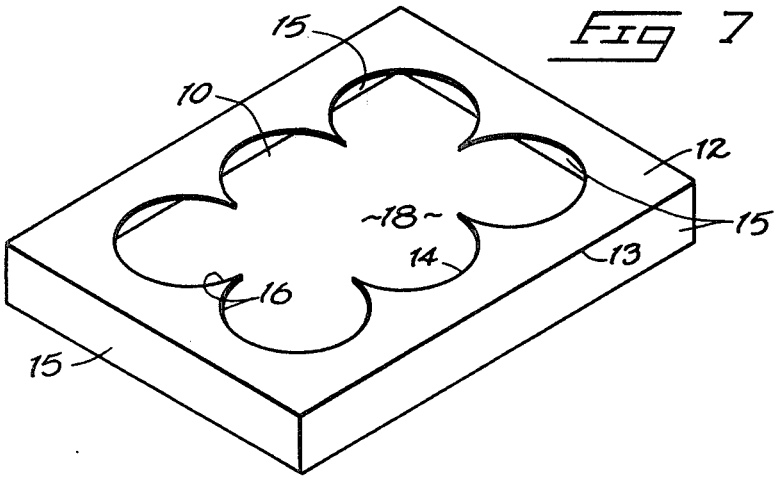
FIG. 7 is a perspective view of the smaller version empty.

The tray is preferably rectangular, being adapted to complement and receive bottles in elongated rows. It is not adapted to receive or support individual bottles not in tangential direct abutment with one another. The object of this tray is to receive a preformed geometrical array of bottles, which can be arranged manually or by suitable machine processes prior to insertion of the bottles within the tray structure. The tray can be used for handling and storing empty bottles in large quantities as shown in FIGS. 1, 3, 4, 5 and 6, or can be scaled down in size to handle filled bottles for storage or sales purposes (FIGS. 2 and 7).

Having described my invention, I claim:

1. A tray for a group of upright bottles arranged in two or more rows of bottles in tangential direct abutment with one another, each bottle having a substantially cylindrical barrel extending upwardly from a tapered keel, said tray comprising:

a stiff completely flat lower wall with outer edges having outer dimensions adequate to elevationally support the heels of a group of bottles arranged with all adjacent bottles in tangential direct abutment with one another;

a stiff completely flat upper wall spaced above the lower wall; said upper wall having an outer circumferential edge corresponding to the shape and dimensions of the outer edges of the lower wall and a continuous inner circumferential edge overlying the lower wall for reception of a group of bottles;

side and end wall means integrally joining the outer edges of said lower and upper walls in positions where the lower and upper walls are parallel to one another and vertically separated by a distance less than the height of the barrel of an individual bottle; the inner circumferential edge of said upper wall defining an open unobstructed scalloped pattern having an arcuate scalloped edge configuration complementary in both size and shape to the size and shape across a portion of the barrels of the individual bottles, said pattern being repeated continuously about the periphery of the inner edge of said upper wall in a spatial arrangement complementary to the location of individual bottles bordering a group, whereby an arcuate portion of the barrels of the bottles bordering each group supported on said lower wall will be frictionally engaged by said upper wall to maintain the group of bottles within said tray by assuring tangential engagement of adjacent bottles with one another.

2. The tray as defined by claim 1 wherein said means joining said lower and upper walls is an upright wall spaced outwardly from said inner circumferential edge of said stiff upper wall by a prescribed distance to define a recess between said inner circumferential edge and said upright wall adapted to receive an elongated stiffener member.

3. The tray as defined by claim 1 wherein the top and bottom walls are rectangular and wherein the side and end walls extend integrally between the respective sides thereof, joining each side of the rectangular surfaces;

the outer edges of the lower and upper walls being defined by parallel fold lines forming said side and end walls.

4. The tray as defined by claim 3 further comprising:

corner tabs formed integrally with the side and end walls and defined by corner tab fold lines perpendicular to the parallel fold lines which join them to the lower and upper walls.

* * * * *